United States Patent [19]

Mörz et al.

[11] Patent Number: 4,472,721

[45] Date of Patent: Sep. 18, 1984

[54] BROADBAND CORRUGATED HORN RADIATOR

[75] Inventors: Günter Mörz, Ludwigsburg; Francesco Intoppa, Allmersbach, both of Fed. Rep. of Germany

[73] Assignee: Licentia Patent-Verwaltungs-G.m.b.H., Frankfurt am Main, Fed. Rep. of Germany

[21] Appl. No.: 357,200

[22] Filed: Mar. 11, 1982

[30] Foreign Application Priority Data

Mar. 13, 1981 [DE] Fed. Rep. of Germany ..... 3109667

[51] Int. Cl.[3] ..... H01Q 13/02

[52] U.S. Cl. ..... 343/786

[58] Field of Search ..... 343/786, 781 R, 781 P, 343/781 CA

[56] References Cited

U.S. PATENT DOCUMENTS 4,356,495 10/1982 Morz ..... 343/786

FOREIGN PATENT DOCUMENTS 1957354 6/1970 Fed. Rep. of Germany ..... 343/786

2525358 10/1976 Fed. Rep. of Germany ..... 343/786

2650388 11/1976 Fed. Rep. of Germany ..... 343/786

OTHER PUBLICATIONS

Carpenter; A Dual Band Corrugated Feed Horn; 1980 Conf. Int. Symp. Dig.; Quebec, Canada; Jun. 1980; pp. 213–216.

*Primary Examiner*—Eli Lieberman

*Attorney, Agent, or Firm*—Spencer & Frank

[57] ABSTRACT

A broadband corrugated horn radiator including a hybrid mode exciting member whose inner cross section is constant over its entrie length and a transition member from the cross section of the hybrid mode exciting member to the cross section of the horn aperture. The length and the inner cross section of the hybrid mode exciting member are dimensioned such that the waveguide mode entering this excitation member is converted completely only to the desired hybrid mode type, the pitch of the wall of the transition member is such that no interference waves are able to exist therein, and the corrugation grooves in all members of the horn radiator are matched, by appropriate dimensioning, to the same transmission bandwith.

8 Claims, 8 Drawing Figures

BROADBAND CORRUGATED HORN RADIATOR

BACKGROUND OF THE INVENTION

The present invention relates to a broadband corrugated horn radiator including a hybrid mode exciting member whose inner cross section is constant over its entire length and a transition member from the cross section of the hybrid mode exciting member to the cross section of the horn aperture.

Corrugated horn radiators are used as primary radiators in reflector antennas. Such radiators are distinguished by a low cross-polarization level, freedom from reflections, good sidelobe suppression and a rotationally symmetrical radiation lobe (E-H matching of the lobe cross sections). A corrugated horn radiator should have these good properties over the broadest possible frequency range. It has, in the past, been attempted, for example in German Auslegeschrift No. 2,152,817, to enlarge the bandwidth by changing the frequency dependency of the impedance at the inner walls of the horn radiator. This is accomplished, according to German Auslegeschrift No. 2,152,817, by special design and dimensioning of the corrugated groove structure in the hybrid mode excitation member and in the transition member to the horn aperture which follows.

However, the transmission bandwidth of the horn radiator cannot be enlarged very much merely by modifying the impedance curve within such a horn radiator.

SUMMARY OF THE INVENTION

It is therefore the object of the present invention to provide a corrugated horn radiator of the above-mentioned type, i.e., a horn radiator including a hybrid mode exciting member and transition member from the constant cross section of the hybrid mode member to the cross section of the horn aperture, whose transmission bandwidth is enlarged without utilization of complicated groove structures.

The above object is accomplished according to the present invention in that in a corrugated horn radiator of the above-mentioned type, the length and the inner cross section of the hybrid mode excitation member are dimensioned such that the waveguide mode entering into this excitation member is converted completely only into the hybrid mode to be utilized, the pitch of the inner wall of the transition member is selected such that no interferring higher order modes are able to exist therein, and the corrugation grooves are matched, in all sections of the horn radiator, to the same transmission bandwidth.

The present invention can be used for corrugated horn radiators having the most diverse cross-sectional shapes, e.g. circular, elliptical, rectangular, etc.

BRIEF DESCRIPTION OF THE PREFERRED EMBODIMENTS

FIG. 1*a* is a graph showing the change of one of the cross-sectional axes, a(z), along the longitudinal axis (z) of the horn radiator of FIG. 1.

FIG. 1*b* is a graph showing the change of the other of the cross-sectional axes, b(z) along the longitudinal axis (z) of the horn radiator of FIG. 1.

FIG. 1*c* is a graph showing a modification of the change of the other of the cross-sectional axes b(z) along the longitudinal axis (z) of the horn radiator of FIG. 1.

DETAILED DESCRIPTION OF THE PREFERRED EMBODIMENTS

Figure 1:
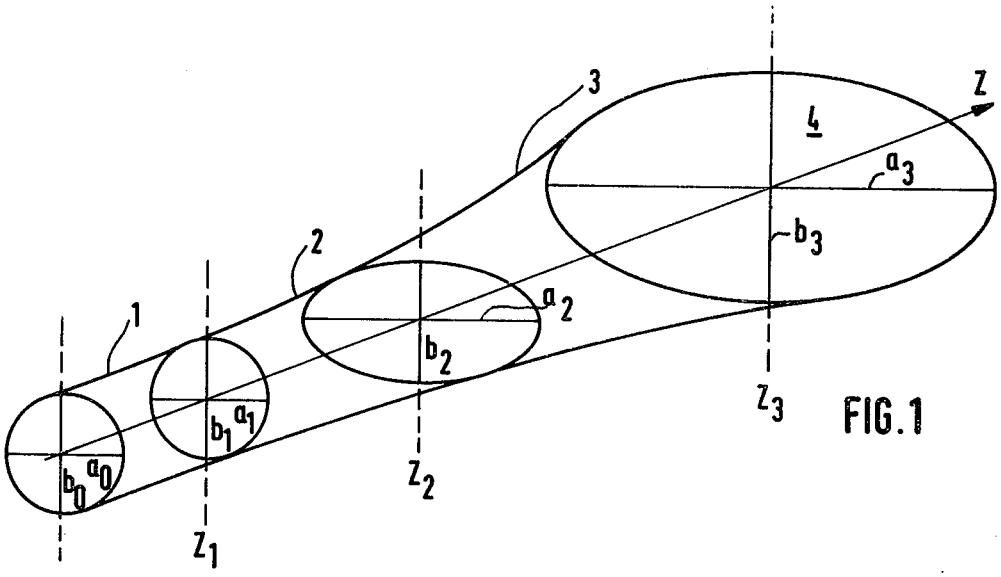

Referring now to FIG. 1, there is shown a horn radiator according to the invention in which, for reasons of clarity, the corrugated groove structure is not shown. The horn radiator begins with a section 1 which converts the incoming waveguide mode to the associated hybrid mode. For example, with a circular cross section as shown, the section 1 converts the incoming waveguide mode to the $HE_{11}$ mode. In order for the radiation properties of the corrugated horn radiator not to become worse, care must be taken that in addition to the desired hybrid mode, no other interferring higher order hybrid modes are excited. For that reason, the inner cross section of the hybrid mode exciting section or member 1 is selected to be large enough so that the useful or desired hybrid mode is just excited and no interferring higher order hybrid mode will be able to exist at the highest transmission frequency. Along its axis, the hybrid mode excitation member 1 has a constant inner cross section (circular as shown) and is of such a length that the entire incoming waveguide mode is completely converted to the associated hybrid mode.

The hybrid mode excitation member 1 is followed by a transition member 2, 3 which changes from the circular cross section of the hybrid mode excitation member 1 in plane $Z_1$ of the illustrated embodiment to the elliptical cross section of the horn aperture 4 in plane $Z_3$. This transition member 2, 3 must be dimensioned such that, as with the hybrid mode exciting member 1, no interferring higher order modes can be excited therein. For this reason, the transition from the cross section of the hybrid mode exciting member 1 to the cross section of the horn aperture takes place in two transition zones or sections 2 and 3. In the first transition zone 2, the cross section of the hybrid mode exciting member 1 is changed to a cross section which corresponds in its shape but not yet in its size to the cross section of the horn aperture 4. The final inner cross section of this zone 2, as shown in plane $Z_2$, should differ as little as possible from the cross section of the hybrid mode exciting member 1 so as to exclude any possibility of interferring higher order mode excitation. This is accomplished in the transition zone 2 of the embodiment shown in FIG. 1 in that beginning with the circular cross section of the hybrid mode exciting member 1 in plane $Z_1$, only one of the two mutually perpendicular cross-sectional axes, e.g., the axis a(z), widens along the z-axis whereas the other axis, e.g. the axis b(z), remains unchanged.

Figure 1A:
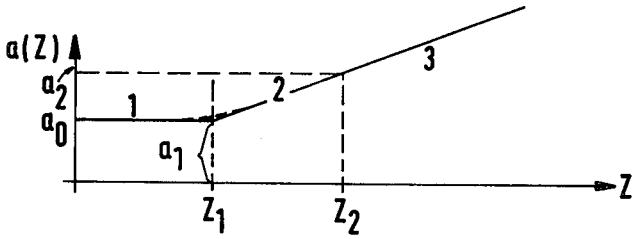
Figure 1B:
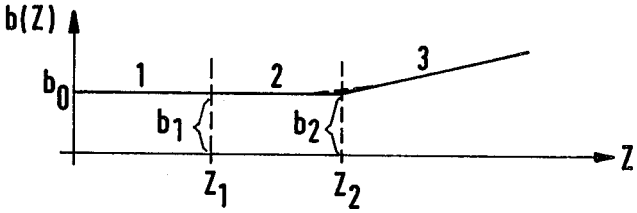

FIGS. 1*a* and 1*b* show the changes in the cross-sectional axes a(z) and b(z) along the z-axis of the embodiment of FIG. 1. The cross-sectional axis a(z) ascends from a value of $a_1 = a_0$ in the $Z_1$ plane at the end of the hybrid exciting member 1 to the value $a_2$ in the $Z_2$ plane at the end of the transition zone 2. The value of the cross-sectional axis b(z) is unchanged from the plane $Z_1$ to the plane $Z_2$, so that the following applies: $b_2=b_1=b_0$.

Figure 1C:
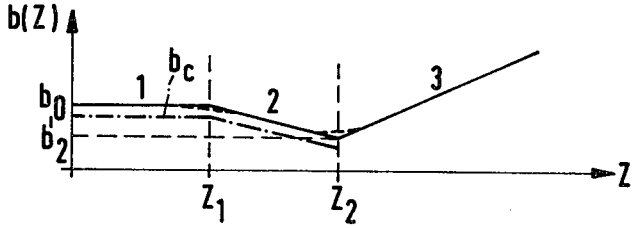

Due to the increase in the value of the cross-sectional axis a(z) and thus the increase in the inner diameter within the transition zone 2, the cutoff frequencies of the interferring higher order modes able to exist in this zone 2 is reduced, which leads to a reduction of the transmission bandwidth. This drawback can be overcome with the following measure. As shown in FIG. 1*c*, the value of the cross-sectional axis b(z) is not kept constant but rather is reduced to a lower value $b_2'$. In this connection it must be noted that the value of b(z) must not fall below a limit value $b_c$ (shown in FIG. 1*c* by a dot-dash line), below which the useful or desireable hybrid mode can no longer propagate.

In either case the axis ratio $a_2/b_2$ or $a_2/b_2'$ of the final cross section of the transition zone 2 should correspond to the axis ratio $a_3/b_3$ of the elliptical horn aperture 4. In the transition zone 3, the elliptical cross section of the plane $Z_2$ is then widened to the horn aperture only in the $Z_2$ plane, with the cross-sectional shape remaining the same.

In the corrugated horn radiator shown in FIG. 1, the values of the cross-sectional axes a(z) and b(z) change linearly in the transition region along the z-axis. However, it is also possible for the values of a(z) and b(z) to have nonlinear but steady function curves (shown by dotted lines in FIGS. 1*a*, 1*b*). In this way it is possible to avoid undesireable sudden bends in the transition member 2, 3.

Figure 2:
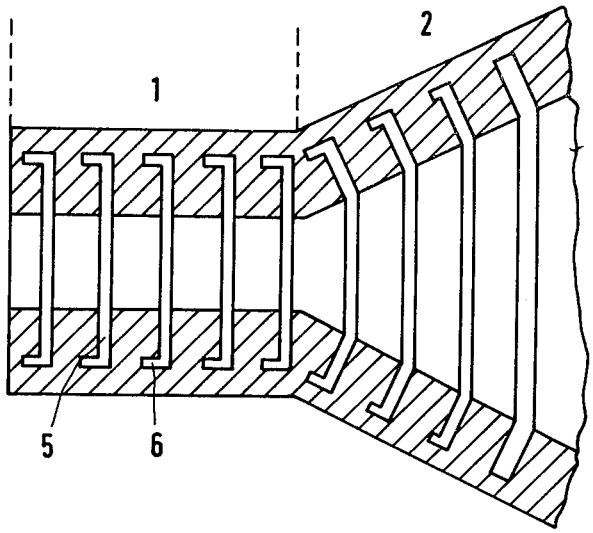
FIG. 2 is a longitudinal sectional view of a horn radiator of which the groove structure is provided with a capacitive load.

Turning now to FIG. 2, there is shown an example of a corrugated horn radiator which has been cut open in the longitudinal direction and in which the corrugation grooves 5 have such a shape that they are matched in all sections 1, 2 of the horn radiator to the same transmission bandwidth. Normally a corrugation groove 5 has a smaller bandwidth in a waveguide section having a small cross section than a corrugation groove in the waveguide section having a larger cross section. In order to realize homogeneous bandwidth matching along the length of the horn radiator axis, the capacitive charge is reduced with increasing cross-sectional size. As can be seen in FIG. 2, the width of the corrugation grooves 5 is therefore enlarged in the transition section or zone 2 together with the increases in cross section and the trap 6 at the end of the corrugation grooves is eventually reduced or even avoided. This measure is required only for extremely large bandwidths (about one octave or higher). Generally it is sufficient to adapt the corrugation groove structure in the excitation member 1 and in the transition member 2, 3 to the required transmission bandwidth in a known manner, e.g. according to the manner disclosed in German Pat. No. 2,616,125. Such matching of the corrugation groove structure involves only a variation of the groove width, depth, and/or spacing in dependence on the location of the respective corrugation groove along the longitudinal axis of the horn radiator. In the horn section 1, such a variation of the corrugation groove structure is necessary already to completely transform the waveguide modes to the corresponding hybrid modes, assuming the lowest possible inherent reflection coefficient.

Even with complete hybrid mode transformation at the output of member 1, it is sometimes necessary to adapt the corrugation grooves in section 2 as well (e.g. corrugation groove depth, corrugation groove spacing) to the local cross section, since the waveguide wavelengths differ locally. With asymmetrical cross sections (e.g. elliptical) of the transition zones 2 and 3, it may become necessary to make this local adaptation of the corrugation grooves different in the two cross-sectional axes a(z) and b(z). For this purpose, it is preferable to vary the corrugation groove depth, which should decrease in a direction toward the horn aperture 4, because corrugation groove depth variation is easiest from a manufacturing point of view. With the aid of such measures it is possible to manufacture an elliptical corrugated horn radiator which has identical phase shifts in two polarizations.

Figure 3:
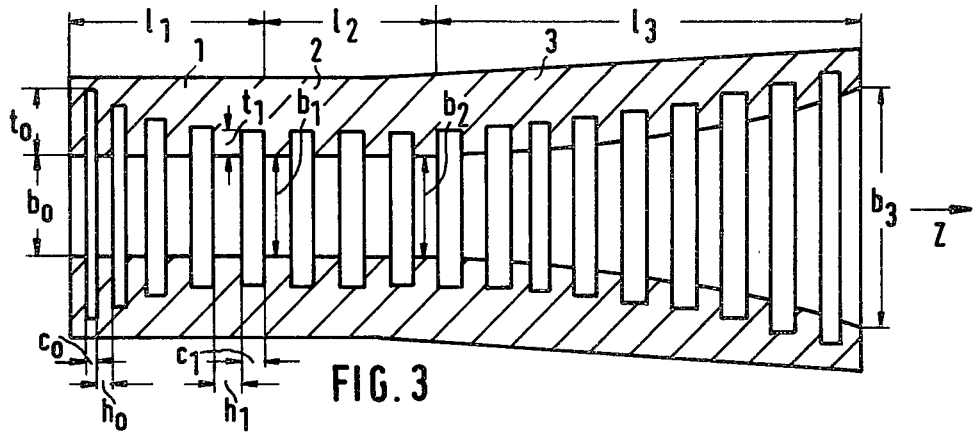
FIG. 3 is a longitudinal sectional view of a horn radiator provided with a groove structure according to the invention.

FIG. 3 shows a specific example of an embodiment of a corrugated horn radiator according to the invention. This figure depicts a longitudinal section view (along the axis b) of the horn radiator. The hybrid mode excitation member 1 and its groove structure are dimensioned as follows. Member 1 has the length $l_1 \simeq 3\lambda_o$, and a diameter $b_o \simeq \lambda_o$, whereby $\lambda_o$ characterizes the free-space wavelength.

Figure 4:
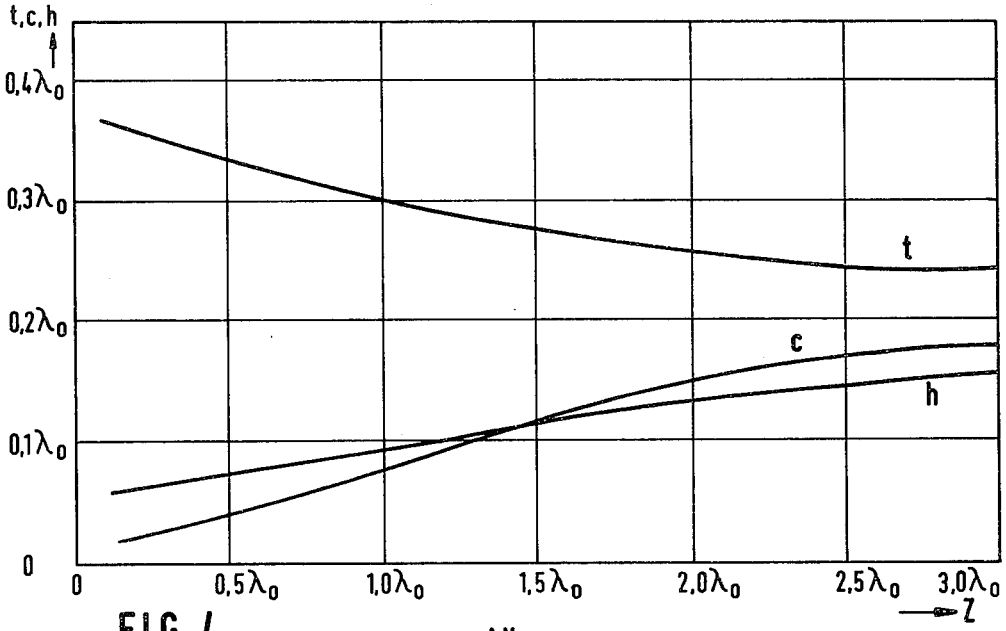
FIG. 4 is a graph showing the changes of the groove depth, of the groove width and of the spacing between adjacent grooves.

The manner in which the groove dimensions, that is, the depth t, the width c and the spacing h between adjacent grooves, vary along the z-axis is shown in the graph of FIG. 4.

The hybrid mode excitation member 1 has the following dimensions at an operating frequency of 15 GHz;

| | |
|---|---|
| $b_o = b_1 \simeq 20$ mm | |
| $l_1 \simeq 60$ mm | |
| $t_o \simeq 7.4$ mm | $t_1 \simeq 5$ mm |
| $c_o \simeq 0.4$ mm | $c_1 \simeq 3.6$ mm |
| $h_o \simeq 1.8$ mm | $h_1 \simeq 2.5$ mm |

The maximum amount by which the pitch of the waveguide transition section 2 can vary, i.e. the maximum pitch angle, is 10°. In the embodiment shown in FIG. 3, the transition section 2 is only enlarged in its cross-sectional axis a ($a_2 > a_1$). The cross-sectional axis b is unchanged ($b_1=b_2$). The axial ratio $a_2/b_2$ of the elliptical section 2 as well as the axial ratio $a_3/b_3$ of the elliptical aperture 4 of the section 3 is equal or less than 2.7.

Figure 5:
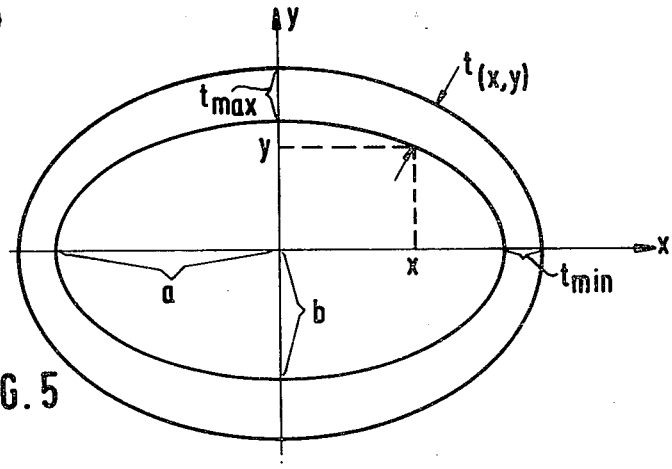
FIG. 5 is a graph showing the different groove depths in the two cross-sectional axes a and b.

As FIG. 3 shows, the grooves in each cross section of the members 2 and 3 have the same widths and spacings between one another. But the groove depth in each cross-section of the elliptically shaped members 2 and 3 increases from a minimum depth $t_{min}$ ($t_{min} \simeq 0.24\lambda_o$ is constant along the z-axis) near the large axis a to a maximum depth $t_{max}$ near the small axis b. FIG. 5 shows the variation of the depth t(x,y) of the groove in one cross section. The increase of the groove depth t(x,y) from the value $t_{min}$ to the value $t_{max}$ is given by the formula $$t(x,y) = t_o + 0.03 \cdot \frac{b^2\left[a^2\left[\sqrt{\left(\frac{x^2}{a^4}+\frac{y^2}{b^4}\right)^3} - \frac{1}{a}\right]\right]}{b + \frac{\left(a-\frac{b^2}{a}\right)^2 - \left(b-\frac{b^2}{a}\right)^2}{2\left(b-\frac{b^2}{a}\right)} - \frac{b^2}{a}}$$

wherein a and b represent the respective half-axes as indicated in FIG. 5.

At an operating frequency of 15 GHz, the sections 2 and 3 have the following dimensions:

$l_2 \simeq 66$ mm
$l_3 \simeq 240$ mm
$a_3 \simeq 62.5$ mm
$b_3 \simeq 24$ mm
$t_{min} \simeq 5$ mm The above described horn radiator has a round hybrid mode excitation member 1 and elliptical waveguide sections 2 and 3. The shape of member 1 can also be square and the shapes of the sections 2 and 3 can also be rectangular.

It will be understood that the above description of the present invention is susceptible to various modifications, changes and adaptations, and the same are intended to be comprehended within the meaning and range of equivalents of the appended claims.

What is claimed is:

1. In a broadband corrugated waveguide horn radiator including a corrugated hybrid mode excitation member whose inner cross section is constant over its entire length and a corrugated transition member from said cross section of the hybrid mode excitation member to the cross section of the horn aperture; the improvement wherein: the length and the inner cross section of said hybrid mode excitation member are dimensioned such that the waveguide mode entering said excitation member is converted completely only to the desired hybrid mode type; the pitch of the wall of said transition member is such that no interferring higher order modes are able to exist therein; and the corrugation grooves in all said members of said horn radiator are matched, by appropriate dimensioning, to the same transmission bandwidth.

2. A broadband corrugated horn radiator as defined in claim 1 wherein: said cross section of said horn aperture and said cross section of said hybrid mode excitation member are different in size and shape; said transition member has a first section which provides a transition from the cross section of said excitation member to an intermediate cross section which corresponds in its shape to the cross section of said horn aperture but differs in its size as little as possible from the cross section of said excitation member, and a second section wherein said intermediate cross section is enlarged to the said cross section of the final horn aperture.

3. A broadband corrugated horn radiator as defined in claim 2 wherein: said excitation member has a circular cross section and said horn aperture is elliptical; said intermediate cross section at the end of said first transition section is an elliptical cross section with only one of its two cross-sectional axes being enlarged compared to the diameter of said circular cross section of said hybrid excitation member; and the ratio of the cross-sectional axes of said elliptical intermediate cross section at the end of said first transition section is equal to the ratio of the cross-sectional axes of said elliptical horn aperture.

4. A broadband corrugated horn radiator as defined in claim 3 wherein the other cross-sectional axis of said elliptical intermediate cross section is unchanged compared to the diameter of said circular cross section of said hybrid excitation member.

5. A broadband corrugated horn radiator as defined in claim 3 wherein the other cross-sectional axis of said elliptical intermediate cross section is reduced compared to the diameter of said circular cross section of said hybrid excitation member.

6. A broadband corrugated horn radiator as defined in claim 1 wherein the shape, the depth and the spacing of the corrugation grooves in said hybrid mode excitation member and in said transition member are adapted to the local, inner waveguide cross section.

7. A broadband corruaged horn radiator as defined in claim 1 wherein said corrugation grooves in said transition member have a capacitive load which steadily decreases in the direction toward said horn aperture.

8. A broadband corrugated horn radiator as defined in one of claims 3 to 7 wherein, the depth of said corrugation grooves along said transition member is designed differently at said two cross-sectional axes, with said difference decreasing in a direction toward said horn aperture.

* * * * *